US010544537B2

(12) United States Patent
Park

(10) Patent No.: US 10,544,537 B2
(45) Date of Patent: Jan. 28, 2020

(54) TOP LOADING TYPE WASHING MACHINE

(71) Applicant: LG ELECTRONICS INC., Seoul (KR)

(72) Inventor: Youngbae Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 56 days.

(21) Appl. No.: 15/552,671

(22) PCT Filed: Feb. 24, 2016

(86) PCT No.: PCT/KR2016/001793
§ 371 (c)(1),
(2) Date: Aug. 22, 2017

(87) PCT Pub. No.: WO2016/137222
PCT Pub. Date: Sep. 1, 2016

(65) Prior Publication Data

US 2018/0030642 A1 Feb. 1, 2018

(30) Foreign Application Priority Data

Feb. 24, 2015 (KR) ..... 10-2015-0025818

(51) Int. Cl.
*D06F 39/10* (2006.01)
*D06F 37/12* (2006.01)
(Continued)

(52) U.S. Cl.
CPC ..... *D06F 39/10* (2013.01); *D06F 23/04* (2013.01); *D06F 33/02* (2013.01); *D06F 37/12* (2013.01); *D06F 37/24* (2013.01); *D06F 37/304* (2013.01)

(58) Field of Classification Search
CPC ..... D06F 39/10; D06F 39/083; D06F 37/12; D06F 23/04
(Continued)

(56) References Cited

U.S. PATENT DOCUMENTS 2,257,932 A * 10/1941 Basler ..... D06F 13/00 68/134
2,744,402 A * 5/1956 Smith ..... D06F 13/00 68/133
(Continued)

FOREIGN PATENT DOCUMENTS

KR 10-0332761 9/2002

OTHER PUBLICATIONS

International Search Report and Written Opinion dated May 18, 2016 issued in Application No. PCT/KR2016/001793 (Full English Text).

*Primary Examiner* — Joseph L. Perrin
(74) *Attorney, Agent, or Firm* — Ked & Associates, LLP

(57) ABSTRACT

A top loading type washing machine including a drum, a hub coupled to the drum, the hub having a hub opening, through which wash water flows in a vertical direction, a filter secured to the hub, the filter having a filter opening, through which the wash water flows in the vertical direction, and a gap forming element formed on at least one of the filter and the hub so as to protrude the other one of the filter and the hub, the gap forming element being configured to form a gap between the filter and the hub. The washing machine provides the flow path of wash water, through which wash water flows in the transverse direction, owing to a gap between the hub and the filter via the gap forming element, and minimizes interference between the wash water and the gap forming element, thus minimizing accumulation of lint on the gap forming element.

20 Claims, 5 Drawing Sheets

(51) Int. Cl.

| | |
|---|---|
| ***D06F 23/04*** | (2006.01) |
| ***D06F 37/24*** | (2006.01) |
| ***D06F 37/30*** | (2006.01) |
| ***D06F 33/02*** | (2006.01) |

(58) Field of Classification Search
USPC ..... 68/18 F, 18 FA
See application file for complete search history.

(56) References Cited

U.S. PATENT DOCUMENTS

| | | | | |
|---|---|---|---|---|
| 3,335,867 | A * | 8/1967 | Perl | A47L 15/4204 134/111 |
| 3,910,076 | A * | 10/1975 | Ruble | D06F 13/00 68/18 F |
| 4,419,870 | A * | 12/1983 | Brenner | D06F 17/10 68/134 |
| 4,455,844 | A * | 6/1984 | McMillan | D06F 39/10 210/167.01 |
| 4,848,105 | A * | 7/1989 | O'Connell | D06F 39/10 68/18 F |
| 5,018,372 | A * | 5/1991 | Altnau, Sr. | D06F 39/10 68/18 F |
| 2006/0075577 | A1 | 4/2006 | Jeong et al. | |
| 2009/0151191 | A1 | 6/2009 | Grunert | |
| 2011/0016736 | A1 | 1/2011 | Kim et al. | |
| 2013/0318813 | A1 | 12/2013 | Hong et al. | |
| 2014/0026624 | A1 | 1/2014 | Oh et al. | |
| 2014/0101866 | A1 * | 4/2014 | Oh | D06F 39/083 8/137 |

* cited by examiner

[Fig. 1]
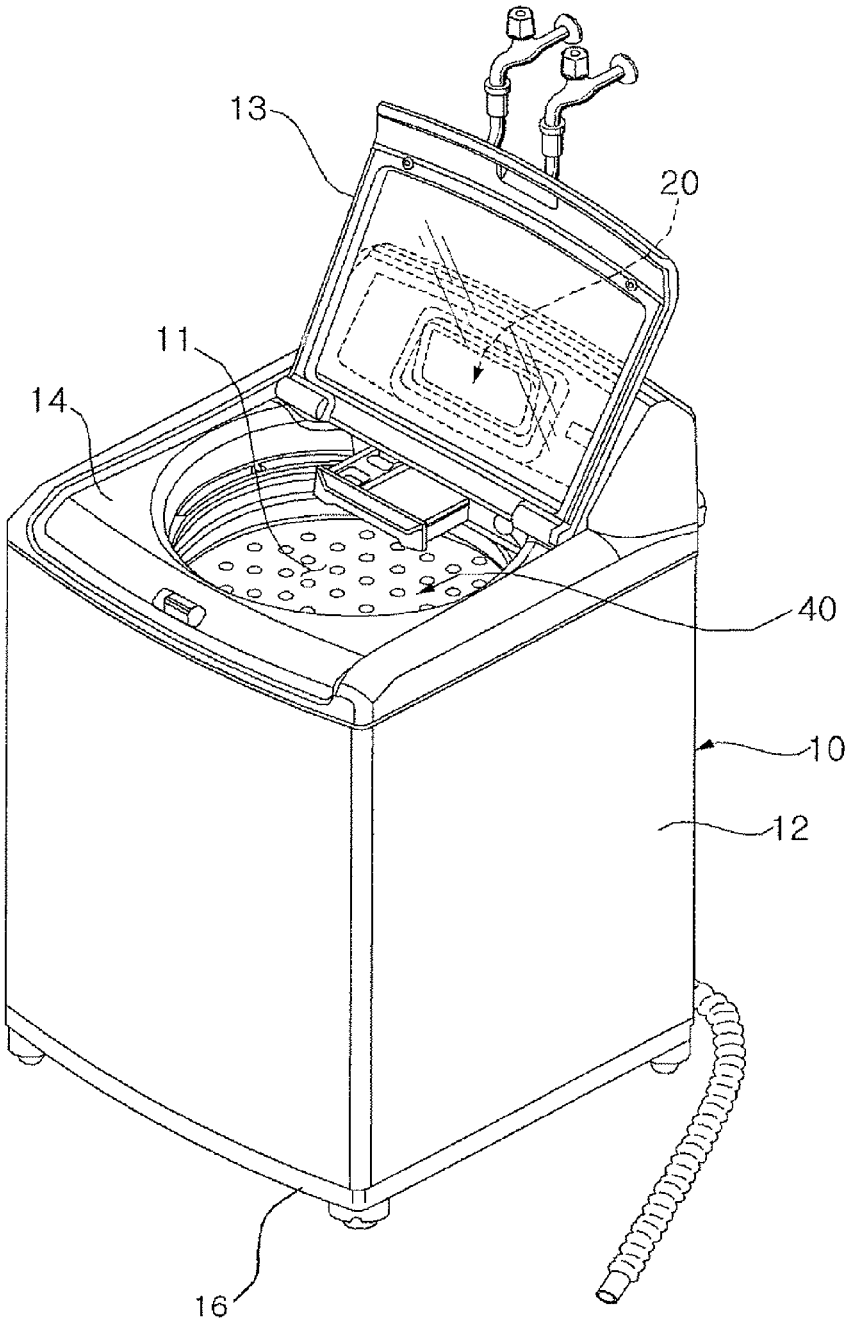

[Fig. 2]
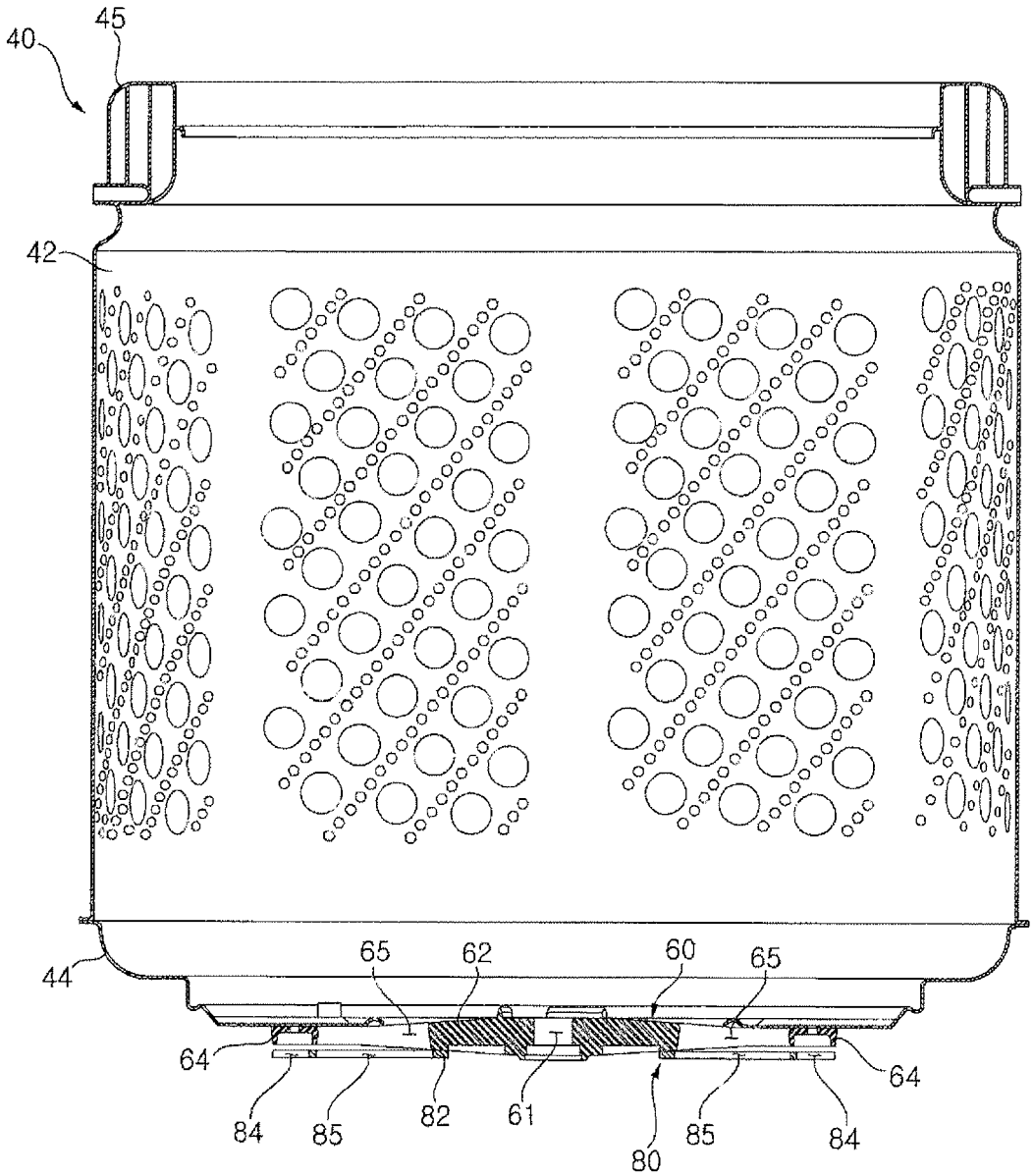

[Fig. 3]
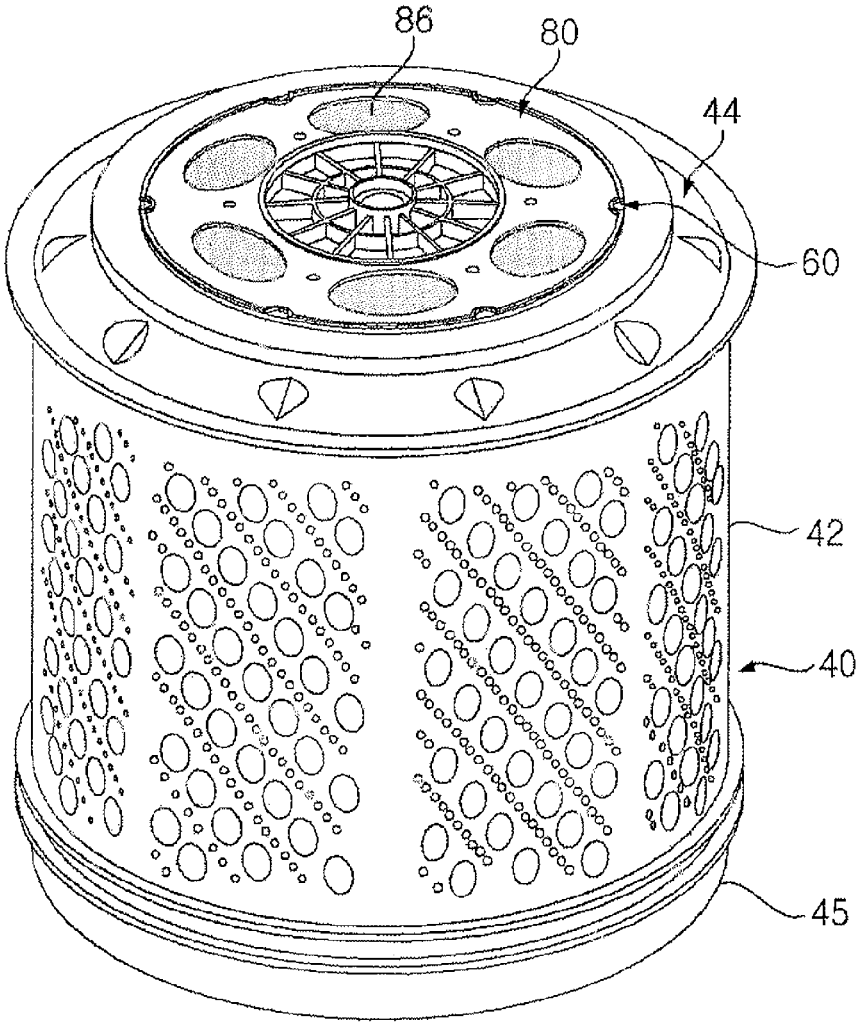

[Fig. 4]
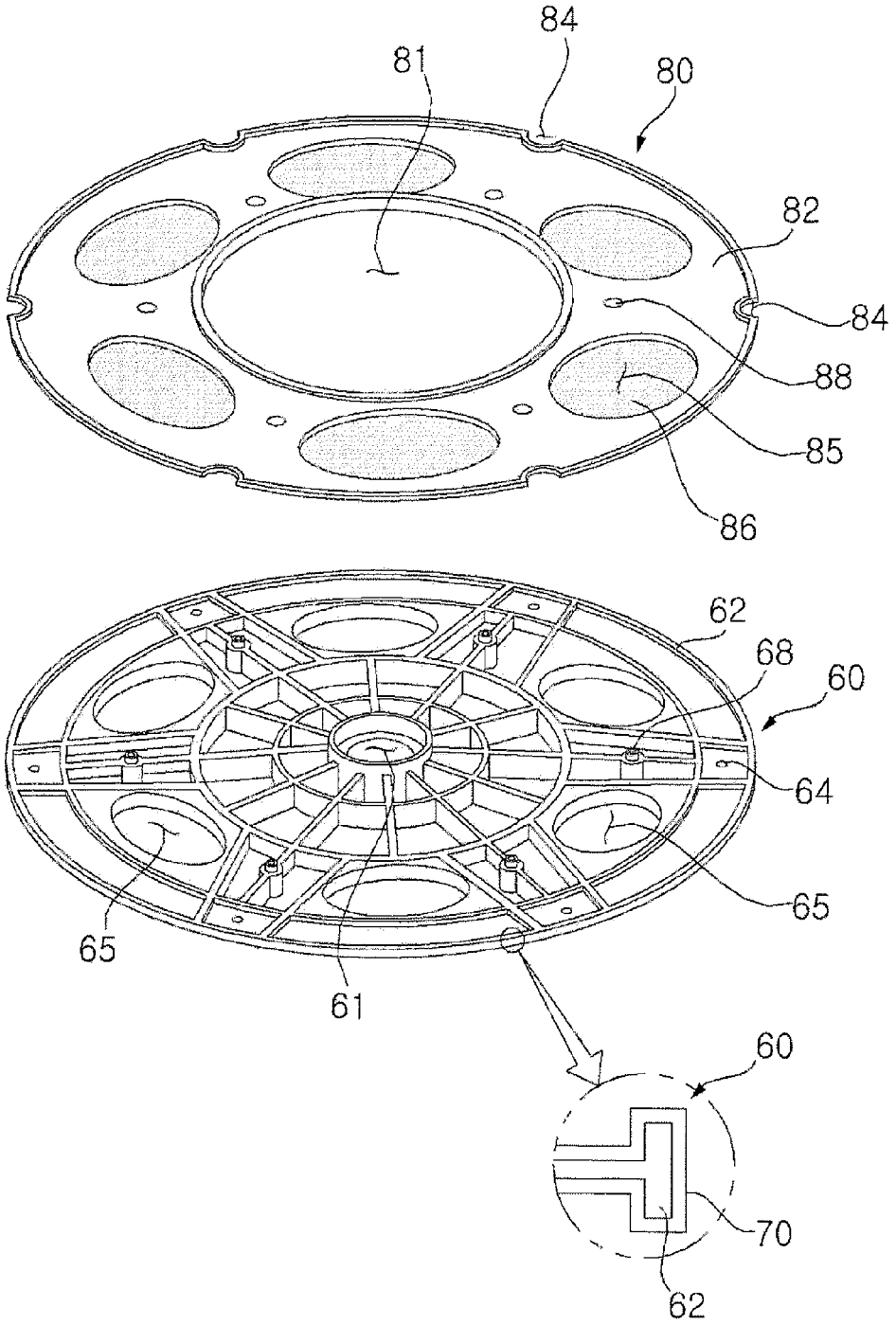

[Fig. 5]
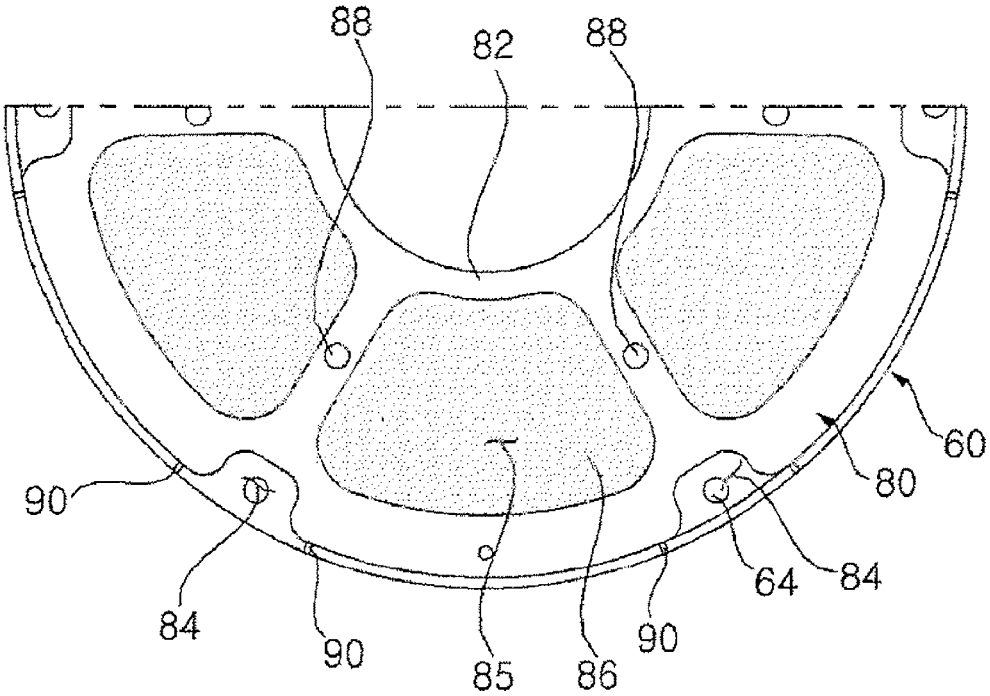
[Fig. 6]
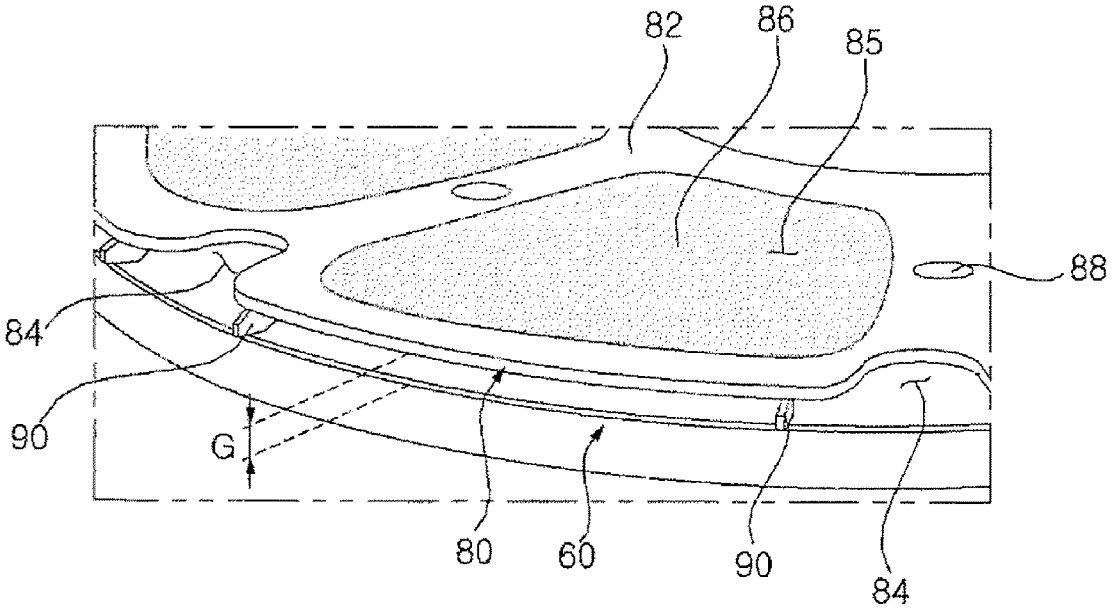

TOP LOADING TYPE WASHING MACHINE

CROSS-REFERENCE TO RELATED PATENT APPLICATIONS

This application is a U.S. National Stage Application under 35 U.S.C. § 71 of PCT Application No. PCT/KR2016/001793, filed Feb. 24, 2016, which claims priority to Korean Patent Application No. 10-2015-0025818, filed Feb. 24, 2015, whose entire disclosures are hereby incorporated by reference.

Technical Field

The present disclosure relates to a top loading type washing machine.

Background Art

In general, a washing machine is an apparatus that washes laundry using, for example, an emulsion of detergent, water streams generated by rotation of a wash tub or washing blades, and shocks applied by the washing blades. The washing machine performs washing, rinsing, or dehydration in order to remove contaminants adhered to laundry (hereinafter referred to as "fabric") using the action of detergent and water.

In addition, washing machines are divided into a top loading type washing machine and a front loading type washing machine according to the position of an opening for the introduction of laundry. The top loading type washing machine has an opening formed in the vertical direction, and the front loading type washing machine has an opening formed in the front-to-back direction.

A top loading type washing machine may include a tub in which wash water is stored, a drum placed inside the tub and configured to implement washing of laundry loaded thereinto, and a motor device placed below the tub to rotate the drum. A pulsator may be provided inside the drum and configured to be selectively rotated by the motor device. In particular, the pulsator may be rotated together with the drum, or may be rotated independent of the drum, by the motor device. The pulsator may problematically generate a great amount of lint because the pulsator implements washing by coming into direct contact with the laundry.

RELATED ART DOCUMENT

Patent Document

Korean Patent Registration No. 10-0332761

DISCLOSURE OF INVENTION

Technical Problem

A top loading type washing machine may include a filter capable of effectively filtering lint. A top loading type washing machine may be capable of preventing lint from accumulating in a filter. A top loading type washing machine may be capable of maintaining a gap between a filter and a hub. A top loading type washing machine may be capable of maintaining the rigidity of a filter.

Solution to Problem

To achieve the above described object, in accordance with an embodiment, a top loading type washing machine may include a drum, a hub coupled to the drum, the hub having a hub opening through which wash water flows in a vertical direction, a filter secured to the hub, the filter having a filter opening through which the wash water flows in the vertical direction, and a gap forming element (or tab) formed on at least one of the filter and the hub so as to protrude toward the other one of the filter and hub, the gap forming element being configured to form a gap between the filter and the hub. The gap forming element may be located at an outer side of the filter opening.

The gap forming element may be configured to extend in a direction in which the wash water flows. The gap forming element may have a longer length than a width thereof. The gap forming element may be configured to extend in a radial direction about a drive shaft of the drum.

The gap forming element may include a plurality of gap forming elements arranged in a circumferential direction about a drive shaft of the drum. At least a portion of the gap forming element may protrude out of the filter. The gap forming element may have an outer end protruding out of the filter so as to be located within a radius of the hub.

The filter may include a filter frame, at least a portion of which may be spaced apart from the gap to form the gap, a filter fixing portion formed in the filter frame and secured to the hub, the filter opening formed in the filter frame, the filter opening being open in the vertical direction to enable flow of the wash water therethrough, and a filter net provided on the filter frame and configured to cover the filter opening to filter lint contained in the wash water, and the gap forming element may be arranged on the filter frame. The filter opening may include a plurality of filter openings, and the gap forming element may be located between the plurality of filter openings.

The hub may further include a hub fixing portion secured to the drum, and the filter opening may include a plurality of filter openings. The filter may further include a filter avoidance region located between the filter opening, with the hub fixing portion being exposed through the filter avoidance region.

The washing machine may further include a drive shaft configured to rotate the drum, the gap forming element may be located at an outer side of the filter avoidance region on the basis of a radial direction of the drive shaft, and the gap forming element may be located on either edge of the filter avoidance region on the basis of a circumferential direction of the drive shaft. The washing machine may further include a drive shaft configured to rotate the drum, and the gap forming element may extend in a radial direction of the drive shaft.

The gap forming element may have a longer length than a width thereof. At least a portion of the gap forming element may protrude out of the filter frame. The gap forming element may have an outer end protruding out of the filter frame so as to be supported by an outer edge of the hub. The gap forming element may have an outer end protruding out of the filter frame so as to be located within a radius of the hub.

Advantageous Effects of Invention

The flow path of wash water, through which wash water flows in the transverse direction, may be advantageously formed through provision of a gap between a hub and a filter via a gap forming element. Owing to minimized interference between the wash water and the gap forming element, accumulation of lint in the gap forming element may be advantageously minimized. Because the gap forming element may be located outside the filter, even if lint accumulates in the gap forming element, the lint may be easily separated by the flow of wash water.

Because the gap forming element may be configured to extend by a long length in the direction in which the wash water flows, the resistance of the gap forming element to the flow of wash water may be minimized. Because the gap forming element may protrude out of a filter frame and may be supported by the outer edge of the hub, a minimum gap may be maintained even if the gap forming element is deformed by the pressure of wash water. The effects of the present disclosure are not limited to the above described effects, and other effects not mentioned above may be clearly understood by those skilled in the art from the description of the claims.

BRIEF DESCRIPTION OF DRAWINGS

The embodiments will be described in detail with reference to the following drawings in which like reference numerals refer to like elements and wherein:

FIG. 1 illustrates a top loading type washing machine in accordance with an embodiment;

FIG. 2 is a sectional view of a drum illustrated in FIG. 1;

FIG. 3 is a perspective view illustrating the bottom of the drum illustrated in FIG. 1;

FIG. 4 is an exploded perspective view of a filter and a hub illustrated in FIG. 3;

FIG. 5 is a bottom view illustrating the bottom of the drum illustrated in FIG. 3; and FIG. 6 is an enlarged view of the filter and the hub illustrated in FIG. 3.

BEST MODE FOR CARRYING OUT THE INVENTION

Referring to FIGS. 1 to 6, the washing machine in accordance with an embodiment may include a cabinet 10, which may define the external appearance of the washing machine, a tub, which may be placed inside the cabinet 10 and configured to store wash water therein, a drum 40 placed inside the tub and configured to implement washing of laundry loaded thereinto, and a drive module (or drive) that rotates the drum 40. The cabinet 10 may include a top cover 14 having a top opening 11 to allow laundry to be introduced into the cabinet in the vertical direction, a door 13 installed to the top cover 14 to open or close the opening 11, and a cabinet main body 12 coupled to the lower side of the top cover 14. The tub, the drum 40, and the driving module may be placed inside the cabinet main body 12, and a base 16 may be coupled to the lower side of the cabinet main body 12, the base 16 being seated on the ground surface. The door 13 may have a transparent window to enable viewing of the interior of the drum 14.

A control module (or a controller) 20 may be installed at or in the top cover 14 and may serve to allow a user to select a washing mode and to inform the user of the operational state of the washing machine. The drive module may be a brushless DC (BLDC) motor and may be secured to the lower surface of the tub. A pulsator may also be provided inside the drum 40.

A rotating shaft of the motor may penetrate the bottom of the tub and may be coupled to the drum 40. The rotating shaft of the motor may be selectively connected to the pulsator. The rotating shaft of the motor may be selectively connected to the drum 40 or the pulsator, and may selectively transmit a torque to the drum 40 or the pulsator.

The tub may be configured to store wash water therein, and may be supported by the cabinet main body 12 via a suspension module (or suspension). The suspension module may absorb vibrations or shocks of the tub. The suspension module may support the tub. The suspension module may suspend the tub from the top cover 14.

The drum 40 may be placed inside the tub, and may be rotated in opposite directions by the torque transmitted from the drive module. The drum 40 may be manufactured as a single element. A drum body 42 and a drum base 44 may be prefabricated and then assembled to construct the drum 40.

An upper balancer 45 may be installed at an upper side of the drum body 42. The drum body 42 may be formed as a cylinder, the upper side and lower side of which may be open. The drum base 44 may form a bottom surface of the drum 40. The drum base 44 may be assembled to the lower side of the drum body 42 and cover the lower side of the drum body 42.

A hub 60 may be installed to the drum base 44. The hub 60 may be assembled to the lower surface of the drum base 44. The torque of the drive module may be transmitted to the hub 60. The drum 40 may be rotated by the torque transmitted to the hub 60.

The hub 60 may include a filter 80 configured to filter lint separated from laundry. The filter 80 may be assembled to the lower side of the hub 60. The hub 60 may be located between the drum base 44 and the drive module and may be secured to the lower surface of the drum base 44. The hub 60 may have a hub shaft hole 61 to allow a penetration of a drive shaft of the drive module. The hub shaft hole 61 may be provided on the inner surface of the hub 60 with vertical serrations. The drive shaft may form the rotation center of the drum 40, the hub 60, and the filter 80. The hub 60 may be selectively connected to the drive shaft and may receive drive power from the drive shaft. The drum 40 may be rotated by the drive power transmitted to the hub 60.

The pulsator may be provided on the upper side of the drum base 44. The drive shaft may be selectively connected to the pulsator, and the drive power may be transmitted to the pulsator connected to the drive shaft. The hub 60 may include a hub body 62 having a disc shape, hub fixing portions 64 formed on the hub body 62 to be coupled to the drum base 44, a plurality of hub openings 65 vertically formed through the hub body 62, and a surface-treated portion 70 formed on the surface of the hub body 62 to restrict contamination and corrosion.

The hub body 62 may be formed of aluminum, or may be formed of any of various other materials. The surface-treated portion 70 may serve to minimize contamination and corrosion due to lint. The surface-treated portion 70 may be implemented in various ways. The surface-treated portion 70 may be formed as an electro-deposition layer. The surface of the hub 60 may be subjected to sanding prior to implementing electro-deposition.

The electro-deposition layer may be formed via electro-deposition. The electro-deposition may use epoxy resin. When current is applied in the state in which a negative electrode is connected to the hub 60 and a positive electrode is connected to the resin, the electro-deposition layer may be evenly formed throughout the surface of the hub 60. The thickness of the electro-deposition layer may be within a range from about 15 μm to about 30 μm.

The drum base 44 and the hub body 62 may be coupled to each other via the hub fixing portions 64. Fastening members (or fasteners) may penetrate the hub fixing portions 64 and may be fastened to the drum base 44. The hub openings 65 may serve as passages of wash water. The hub opening 65 may reduce the weight of the hub 60. The hub openings 65 may allow the wash water to pass through the hub 60 in the vertical direction of the drum 40.

The wash water may be introduced or discharged through holes formed in the drum base 44. The holes of the drum base 44 and the hub openings 65 may maximize the flow of wash water in the lower side of the drum 40. When the wash water is drained, the wash water may be easily discharged through the holes of the drum 40 and the hub openings 65.

The hub openings 65 may be arranged around the drive shaft. The hub openings 65 may be radially arranged about the drive shaft. The hub openings 65 may be located between fastening bosses 68, which will be described below, in the circumferential direction.

The filter 80 may serve to filter lint contained in the wash water. The filter 80 may be located between the hub 60 and the tub. The filter 80 may be located at the lower side of the hub 60. The filter 80 may be secured to the hub 60 and may be located at the lower side of the hub 60. The filter 80 and the hub 60 may be arranged to face each other.

The filter 80 may include a filter frame 82, at least a portion of which may be spaced apart from the hub 60, a plurality of filter fixing portions (or the filter fixing holes) 88 formed in the filter frame 82 and secured to the hub 60, a filter opening 85 formed in the filter frame 82 to enable the flow of wash water, a filter net 86 secured to the filter frame 82 so as to shield the filter opening 85 for filtering the lint, and a plurality of gap forming elements (or tabs) 90 formed on the filter frame 82 and supported by the hub 60 so as to space the hub 60 and the filter frame 82 from each other. The filter frame 82 may have a ring shape. A through-hole 81 may be formed in the filter frame 82 to enable the penetration of the drive shaft.

The through-hole 81 may be wide to correspond to the shape of the hub 60. The wash water may flow through the through-hole 81. The hub 60 may be exposed through the through-hole 81.

The filter frame 82 may be formed of a synthetic resin and may be elastically deformable. A plurality of filter openings 85 may be arranged in the circumferential direction about the drive shaft. The filter openings 85 may correspond with the hub openings 65. The filter opening 85 may be slightly wider than the hub opening 65.

The filter fixing portions 88 may be located between the filter openings 85. The filter fixing portions 88 may be radially arranged about the drive shaft. The filter fixing portions 88 may be arranged in a circumferential direction about the drive shaft. The hub 60 may be provided with the fastening bosses 68 corresponding to the filter fixing portions 88.

The filter 80 may further include filter avoidance regions 84. The hub fixing portions 64 may be exposed through the filter avoidance regions 84. The filter avoidance regions 84 may enable the avoidance of interference with the fastening members that are fastened to the hub fixing portions 64. The filter avoidance regions 84 may be located between the filter openings 85. The hub fixing portions 64 may be exposed downward through the filter avoidance regions 84. The filter avoidance regions 84 may ensure easy assembly or disassembly of the fastening members with respect to the hub fixing portions 64.

The filter net 86 may include a plurality of pores. The filter net 86 may be manufactured by crossing metal or synthetic resin wires. The filter net 86 may have a mesh form. The mesh size may be set to any of various sizes.

The filter net 86 and the hub body 62 may be spaced apart from each other by a prescribed distance to form a gap G. The gap G may be formed within a range from about 3 mm to about 8 mm. This may ensure the smooth flow of wash water. The wash water may flow between the filter 80 and the hub 60 through the gap G. The gap G may allow the wash water to flow in the transverse direction between the filter 80 and the hub 60. Some of the wash water introduced or discharged through the drum base 44 may flow through the filter openings 85 or the through-hole 81 in the vertical direction. The remaining wash water introduced or discharged through the drum base 44 may flow in the transverse direction through the gap G.

When the drum 40 or the pulsator is rotated, the wash water may flow to the inner surface of the tub by centrifugal force. When this flow of wash water in the transverse direction occurs, the wash water may separate the lint from the filter net 86. The gap may need to maintain a minimum distance during washing, rinsing, or dehydration. The filter 80 may further include the gap forming elements 90 to form the gap G. The gap forming elements 90 may be configured to space the filter frame 82 and the hub 60 from each other by a distance corresponding to the minimum gap G.

The gap forming elements 90 may be located between the filter frame 82 and the hub 60. The gap forming elements 90 may protrude from the filter frame 82 toward the hub 60. The gap forming elements 90 may alternatively be formed on the hub 60. When the gap forming elements 90 are formed on the hub 60, the gap forming elements 90 may protrude toward the filter 80. The gap forming elements 90 may be formed on each of the hub 60 and the filter 80. The gap forming elements 90 may form the gap G.

The gap forming elements 90 may be positioned so as to minimize interference with the wash water. This interference may include interference with wash water flowing through the gap G as well as interference with wash water flowing at the outside of the drum 40. To minimize the interference with wash water, the gap forming elements 90 may be located on the outer edge or the inner edge of the filter frame 82. The gap forming elements 90 may be located on an imaginary straight line, which is defined by the drive shaft, the filter avoidance regions 84, and the filter fixing portions 88.

The gap forming elements 90 may be located outside the filter openings 85. The gap forming elements 90 may be located on the edge of the filter frame 82 at the outer side of the filter avoidance regions 84. The gap forming elements 90 may be arranged in the circumferential direction of the filter frame 82 on the basis of the drive shaft.

The gap forming elements 90 may extend by a long length. The gap forming elements 90 may be configured to protrude, but may not define the longitudinal direction. The gap forming elements 90 may extend in the radial direction on the basis of the drive shaft of the drum 40. The gap forming elements 90 may be radially arranged on the basis of the drive shaft of the drum 40.

The longitudinal direction of the gap forming element 90 may be the direction in which the wash water flows. In addition, the gap forming element 90 may have a longer length than a width thereof. The gap forming element 90 may have an arcuate shape. The outer end of the gap forming element 90 may protrude further outward than the outer edge of the filter frame 82. The outer end of the gap forming element 90 may not exceed the outer edge of the hub 60.

Because the outer end of the gap forming element 90 is located within the radius of the hub 60, the outer end may minimize resistance to the flow of the wash water when the drum 40 is rotated. When viewed from the bottom surface of the drum 40, a portion of the outer end of the gap forming element 90 may be exposed to the outside of the filter frame 82, and may be located below the hub 60. The gap forming element 90 may have a pointed outer end. The gap forming element 90 may take the form of a parallelogram and may be supported by the outer edge of the hub 60.

Through the arrangement of the gap forming elements 90, it may be possible to minimize accumulation of lint. In addition, accumulation of lint may be minimized via the shape of the gap forming element 90. The lint accumulated on the filter net 86 may be discharged by the wash water that flows in the transverse direction through the gap G.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A top loading type washing machine comprising:
- a drum;
- a hub coupled to the drum, the hub having a hub opening through which wash water flows in a vertical direction;
- a filter having
  - a filter frame secured to the hub,
  - at least one filter opening through which the wash water flows in the vertical direction, and
  - a filter net provided on the filter frame to cover the at least one filter opening to filter lint contained in the wash water; and
- at least one tab formed on the filter frame to protrude toward the hub such that a gap is formed between the filter and the hub, wherein the at least one tab is extended outward past an outer edge of the filter frame along a radial direction from a drive shaft of the drum, and an outer end of the at least one tab is provided within a radius of the hub.

2. The washing machine according to claim 1, wherein the at least one tab is located at an outer side of the filter opening.

3. The washing machine according to claim 1, wherein the at least one tab is configured to extend in a direction in which the wash water flows.

4. The washing machine according to claim 1, wherein the at least one tab has a longer length than a width thereof.

5. The washing machine according to claim 1, wherein the at least one tab includes a plurality of tabs arranged in a circumferential direction about the drive shaft of the drum.

6. The washing machine according to claim 1, wherein the filter includes a filter fixing portion formed in the filter frame and secured to the hub.

7. The washing machine according to claim 1, wherein the at least one filter opening includes a plurality of filter openings, and the at least one tab is located between the plurality of filter openings.

8. The washing machine according to claim 1, wherein the hub further includes a hub fixing portion secured to the drum, and wherein the at least one filter opening includes a plurality of filter openings, and the filter further includes a filter avoidance region located between the at least one filter opening, the hub fixing portion being exposed through the filter avoidance region.

9. The washing machine according to claim 8, wherein the drive shaft is configured to rotate the drum, wherein the at least one tab is located at an outer side of the filter avoidance region on the basis of a radial direction of the drive shaft, and wherein the at least one tab is located on either edge of the filter avoidance region on the basis of a circumferential direction of the drive shaft.

10. The washing machine according to claim 1, wherein the at least one tab has a longer length than a width thereof.

11. The washing machine according to claim 1, wherein the outer end of the at least one tab is supported by an outer edge of the hub.

12. The washing machine according to claim 1, wherein the tab has a pointed end.

13. The washing machine according to claim 1, wherein the tab has an arcuate shape or a parallelogram shape.

14. The washing machine according to claim 1, further including a layer electro-deposited on a surface of the hub, wherein the layer is configured to minimize contamination and corrosion from lint accumulating on the hub.

15. A top loading type washing machine comprising:
- a drum;
- a hub coupled to the drum via at least one hub fixing portion, the hub having a hub opening through which wash water flows in a vertical direction;
- a filter secured to the hub such that an outer edge of the filter extends past the at least one hub fixing portion, the filter having at least one filter opening through which the wash water flows in the vertical direction, wherein the filter is fixed to the hub by a filter fixing portion and a fastening boss protruded from the hub toward the filter fixing portion; and
- at least one tab formed on one of the filter or the hub so as to protrude toward another one of the filter or the hub, the at least one tab forming a gap in the vertical direction between the filter and the hub, wherein the at least one tab extends laterally in a space created by a lateral distance between the outer edge of the filter and an outer edge of the hub.

16. The washing machine of claim 15, wherein an outer diameter of the filter is less than an outer diameter of the hub, and a length of the space is equal to a difference in the outer diameters of the filter and the hub.

17. The washing machine of claim 15, wherein a difference in diameter between the filter and the hub is based on the at least one tab.

18. The washing machine of claim 15, further including a plurality of grooves such that the hub fixing portion is exposed through the groove, wherein an outer end of the tab extends into the space, and an inner end of the tab is provided at an outer side of the groove.

19. A washing machine comprising:
- a drum;

a hub coupled to the drum via at least one hub fixing portion at an outer edge of the hub, the hub having a hub opening through which wash water flows;

a filter secured to the hub, the filter having at least one filter opening through which the wash water flows, and at least one recess through which the at least one hub fixing portion is exposed; and at least one tab formed on an outer edge of at least one of the filter or the hub, to be provided at at least one side of the at least one recess, wherein a height of the tab defines a gap between the hub and the filter.

20. The washing machine of claim 19, wherein the gap has a height between 3 mm and 8 mm.

* * * * *